United States Patent [19]

Bird et al.

[11] 4,337,167

[45] * Jun. 29, 1982

[54] CONTAINER FOR RADIOACTIVE NUCLEAR WASTE MATERIALS

[76] Inventors: John M. Bird, 681 Snyder Hill Rd., Ithaca, N.Y. 14850; Alfred E. Ringwood, 3 Vancouver St., Red Hill, Canberra, Australian Capitol Territory 2603, Australia

[ * ] Notice: The portion of the term of this patent subsequent to Mar. 11, 1997, has been disclaimed.

[21] Appl. No.: 118,818

[22] Filed: Feb. 5, 1980

Related U.S. Application Data

[63] Continuation of Ser. No. 878,113, Feb. 15, 1978, Pat. No. 4,192,765.

[51] Int. Cl.[3] ..... G21F 1/08

[52] U.S. Cl. ..... 252/633; 250/506

[58] Field of Search ..... 252/301.1 W; 40/250, 40/506, 507

[56] References Cited

U.S. PATENT DOCUMENTS 3,659,107 4/1972 Selle et al. ..... 250/506

3,935,467 1/1976 Gablin ..... 252/301.1 W

OTHER PUBLICATIONS

Frantzevich et al., *Chem. Abstracts,* vol. 82, No. 2, #9192q, Jan. 1975.

*Primary Examiner*—Deborah L. Kyle

*Attorney, Agent, or Firm*—John J. Byrne

[57] ABSTRACT

Disclosed are two improved container materials for radioactive nuclear waste. Radioactive nuclear waste can be contained over extended periods of time by encapsulating the waste materials in containers composed of these alloys and burying the containers underground in an impervious, stable rock formation.

18 Claims, No Drawings

CONTAINER FOR RADIOACTIVE NUCLEAR WASTE MATERIALS

This is a continuation of application Ser. No. 878,113, filed Feb. 15, 1978 now U.S. Pat. No. 4,192,765.

FIELD OF THE INVENTION

This invention relates to improved nuclear waste container materials possessing high corrosion resistance when buried in natural rock formations. Integrity is obtained by the use of alloys which are thermodynamically stable in the geochemical environment of natural underground rock systems.

BACKGROUND OF THE INVENTION

Modern nuclear reactors produce highly radioactive fission products and actinide elements which must be prevented from entering the biosphere over periods ranging from 10 to 1,000,000 years. The current policy and practice is to convert these high-level nuclear wastes to solid forms, such as glasses or ceramics, which are then encapsulated in metal containers and buried underground in impervious, stable rock formations.

There are a great many patents directed to the structure of containers for nuclear wastes. Most contain only brief disclosures of the materials from which the containers are made. Stainless steel is named repeatedly, as well as iron, steel, lead, concrete, steel lined with copper, brass, zirconium alloy, cadmium, tantalum, tungsten, mercury, molybdenum, and sandwich constructions employing various gels and fibers between layers of metal. Perhaps the closest to the subject invention is U.S. Pat. No. 3,659,107, issued to Seele et al. on Apr. 25, 1972, which describes a radioactive fuel capsule, not a waste container, but which states that it may be made of various refractory materials, including nickel and alloys thereof.

Because of the presence of chromium in stainless steel and other components in the other container materials now in use, they are all more or less thermodynamically unstable in the geochemical environments of natural rock formations, and it is accepted that they can become corroded and decompose within a few tens of years after burial. Accordingly, primary emphasis in immobilizing nuclear wastes is placed upon the insolubility of the radioactive elements in the solidified waste and on the impermeability and ion-exchange properties of the rock medium. However, while this solution has been the best available, it is far from completely satisfactory and it has long been obvious that, if the integrity of the metal container itself could be guaranteed for periods exceeding a million years, the problems associated with safe storage of nuclear wastes would be substantially reduced.

OBJECTS OF THE INVENTION

It is, therefore, a general object of the invention to provide containers for radioactive nuclear waste materials which will obviate or minimize problems of the type previously described.

It is a particular object of the invention to provide such containers which will maintain their integrity for periods exceeding a million years.

It is a further object of this invention to obtain this integrity by the use of alloys which, unlike container materials hitherto used, are thermo-dynamically stable in the geochemical environment of natural underground rock systems.

Other objects and advantages of the present invention will become apparent from the following detailed description thereof.

DETAILED DESCRIPTION

During the metamorphic alteration of ultramafic rocks to form serpentine, native nickel-iron alloys are often produced under thermodyanmically stable conditions. These alloys constitute the mineral awaruite and are composed mainly of nickel (60 to 90 percent) and iron (10 to 40 percent), together with small amounts of cobalt and copper (less than 5 percent each). The most common composition corresponds to the formula $Ni_3Fe$, which is that of an ordered stoichiometric phase. Awaruite has been produced at elevated temperatures, probably exceeding 300° C., during serpentinization of periodotite. In some examples, serpentinization has been caused by circulating sea water. In both cases, it can be demonstrated that occurrences of awaruite have survived for periods exceeding tens of millions of years.

Another natural alloy which is found in serpentinized periodotite in large lumps is josephinite, which has a chemical composition similar to awaruite. The origin of josephinite is unclear, but it can be demonstrated that this alloy has also survived in association with serpentine and periodotite for periods exceeding tens of millions of years.

Both awaruite and josephinite are thermodynamically stable over wide ranges of Eh, pH, temperature, pressure, and in the presence of ground waters containing substantial amounts of chloride ions and other solutes in the natural geochemical environment. Moreover, these alloys have a high melting point, high mechanical strength, and can be cast, fabricated, and machined. Because of these properties, it has become apparent to us that these alloys make ideal containers for solid nuclear waste materials which are to be buried underground in the natural geochemical environment. This is the essence of our invention. Both minerals are known per se, and we of course do not claim to have discovered or invented the minerals as such. Similarly, our invention is not a new structural design for nuclear waste containers, nor is it limited to any particular waste container structure.

What is claimed is:

1. A container for radioactive nuclear waste materials which are ultimately to be buried underground, said container being composed of a native nickel-iron alloy produced under thermodynamically stable conditions and possessing a composition in the range exhibited by the natural materials awaruite and josephinite.

2. A container as recited in claim 1 wherein said alloy is selected from the group consisting of awaruite and josephinite.

3. A container as recited in claim 2 wherein said alloy is awaruite.

4. A container as recited in claim 2 wherein said alloy is josephinite.

5. A container as recited in claim 1 wherein the nickel content of said alloy is in the range 60–90 percent and the iron content of said alloy is in the range 10–40 percent.

6. A container as recited in claim 5 wherein said alloy also contains up to 5 percent cobalt.

7. A container as recited in claim 6 wherein said alloy also contains up to 5 percent copper.

8. A container as recited in claim 5 wherein said alloy also contains up to 5 percent copper.

9. A container as recited in claim 1 wherein said alloy is composed of the stoichiometric alloy phase $Ni_3Fe$.

10. A method of containing radioactive nuclear waste materials over extended periods of time, said method comprising the steps of:

(a) encapsulating the waste materials in a container composed of a native nickel-iron alloy produced under thermodynamically stable conditions and possessing a composition in the range exhibited by the natural materials awaruite and josephinite and (b) burying the container underground in an impervious, stable rock formation.

11. A container for radioactive nuclear waste materials which are ultimately to be buried underground, said container being composed of a nickel-iron alloy having the properties of those natural minerals produced under thermodynamically stable conditions within serpentinite-type rocks and possessing a composition in the range exhibited by the mineral awaruite.

12. A container as recited in claim 11 wherein said alloy is awaruite.

13. A container as recited in claim 11 wherein the nickel content of said alloy is in the range 60–90 percent and the iron content of said alloy is in the range 10–40 percent.

14. A container as recited in claim 13 wherein said alloy also contains up to 5 percent cobalt.

15. A container as recited in claim 14 wherein said alloy also contains up to 5 percent copper.

16. A container as recited in claim 13 wherein said alloy also contains up to 5 percent copper.

17. A container as recited in claim 11 wherein said alloy is composed of the stoichiometric alloy phase $Ni_3Fe$.

18. A method of containing radioactive nuclear waste materials over extended periods of time, said method comprising the steps of:

(1) encapsulating the waste materials in a container composed of a nickel-iron alloy having the properties of those natural minerals produced under thermodynamically stable conditions within serpentinite-type rocks and possessing a composition in the range exhibited by the mineral awaruite and (2) burying the container underground in an impervious stable rock formation.

* * * * *